US005436532A

United States Patent [19]

Benard et al.

[11] Patent Number: 5,436,532

[45] Date of Patent: Jul. 25, 1995

[54] FLUORESCENT LAMP WITH IMPROVED EFFICIENCY

[75] Inventors: David J. Benard, Thousand Oaks, Calif.; David F. Beat, Cedar Rapids, Iowa

[73] Assignee: Rockwell International Corporation, Seal Beach, Calif.

[21] Appl. No.: 37,956

[22] Filed: Mar. 26, 1993

[51] Int. Cl.[6] ..... H05B 41/20

[52] U.S. Cl. ..... 315/244; 315/246; 315/276; 315/291

[58] Field of Search ..... 315/244, 246, 276, 291, 315/307, DIG. 2, DIG. 4, DIG. 5, DIG. 7, 308, 310

[56] References Cited

U.S. PATENT DOCUMENTS

| | | | |
|---|---|---|---|
| 3,886,405 | 5/1975 | Kubo | 315/246 |
| 4,051,411 | 9/1977 | Knoble et al. | 315/246 X |
| 4,122,375 | 10/1978 | Stüdli | 315/98 |
| 4,385,262 | 5/1983 | Cambier et al. | 315/307 |
| 4,463,284 | 7/1984 | Tamura et al. | 315/158 |
| 4,559,478 | 12/1985 | Fuller et al. | 315/224 |
| 4,652,797 | 3/1987 | Nilssen | 315/246 X |
| 5,004,959 | 4/1991 | Nilssen | 315/291 |
| 5,038,079 | 8/1991 | Szuba | 315/158 |
| 5,041,767 | 8/1991 | Doroftei et al. | 315/DIG. 7 |
| 5,059,869 | 10/1991 | Albach et al. | 315/244 X |
| 5,111,118 | 5/1992 | Fellows et al. | 315/307 |
| 5,118,992 | 6/1992 | Szuba | 315/158 |

OTHER PUBLICATIONS

Davenport, et al., "Current Interrupt System", Journal of the Illuminating Engineering Society, vol. 18, pp. 3–8, Jan. 1989.

*Primary Examiner*—Willis R. Wolfe

*Attorney, Agent, or Firm*—John J. Deinken

[57] ABSTRACT

Power is provided to a fluorescent lamp by connecting a source of alternating electrical current, consisting of a series of alternately positive and negative current pulses, to the lamp and shaping the current pulses such that the absolute value of the current increases as a function of time within each pulse. The shaped current source may be provided by a switched mode drive circuit, including a power transformer having a primary winding and a secondary winding, the power transformer secondary winding being connected to the lamp; a flyback transformer having a primary winding and a secondary winding, a first terminal of the flyback transformer primary winding being connected to the center of the power transformer primary winding and a second terminal of the flyback transformer primary winding being connected to a positive terminal of a source of direct current electrical power; a first switch connected between a first terminal of the power transformer primary winding and a negative terminal of the power source; a second switch connected between a second terminal of the power transformer primary winding and the negative terminal of the power source; a diode connected between a first terminal of the flyback transformer secondary winding and the second terminal of the flyback transformer primary winding, such that current is limited to flowing from the secondary winding to the primary winding of the flyback transformer; and a capacitor connected between the first and second terminals of the power source. A digital control circuit may be coupled to the first and second switches to open and close the switches in a time sequenced pattern, thereby causing the current pulses to be shaped such that the absolute value of the current increases as a function of time within each pulse.

5 Claims, 3 Drawing Sheets

FLUORESCENT LAMP WITH IMPROVED EFFICIENCY

BACKGROUND OF THE INVENTION

This invention is concerned with fluorescent lighting systems and particularly with techniques for maximizing the efficiency of such systems, i.e., providing a maximum amount of light output as a function of the amount of electrical power which is input to the fluorescent lamp.

It is well known that the efficiency and reliability of a fluorescent lamp can be affected by the characteristics of the electrical power which is used to drive the lamp. Thus many techniques have been disclosed in the prior art for controlling the electrical input to such a lamp while achieving a high efficiency concurrent with maintaining long lamp life and safe and reliable operation. Davenport and Duffy (Current Interrupt System, Journal of the Illuminating Engineering Society, Volume 18, Pages 3–8 (1989)), for example, achieved improvements in the efficiency of fluorescent lamps by using transient overvoltage and subsequent current interruption as a means of ballasting. The discharge was fully interrupted, with zero voltage and current between imposed voltage transients.

SUMMARY OF THE INVENTION

It is an outstanding feature of this invention to provide a new technique for supplying power to a fluorescent lamp, thereby significantly increasing the efficiency of operation of the lamp. Power is provided by connecting a source of alternating electrical current, consisting of a series of alternately positive and negative current pulses, to the lamp and shaping the current pulses such that the absolute value of the current increases as a function of time within each pulse.

The shaped current source of this invention may be provided by a switched mode drive circuit, including a power transformer having a primary winding and a secondary winding, the power transformer secondary winding being connected to the lamp; a flyback transformer having a primary winding and a secondary winding, a first terminal of the flyback transformer primary winding being connected to the center of the power transformer primary winding and a second terminal of the flyback transformer primary winding being connected to a positive terminal of a source of direct current electrical power; a first switch connected between a first terminal of the power transformer primary winding and a negative terminal of the power source; a second switch connected between a second terminal of the power transformer primary winding and the negative terminal of the power source; a diode connected between a first terminal of the flyback transformer secondary winding and the second terminal of the flyback transformer primary winding, such that current is limited to flowing from the secondary winding to the primary winding of the flyback transformer, and a capacitor connected between the first and second terminals of the power source.

A digital control circuit may be coupled to the first and second switches to open and close the switches in a time sequenced pattern, thereby causing the current pulses to be shaped such that the absolute value of the current increases as a function of time within each pulse.

DESCRIPTION OF THE INVENTION

Figure 1:
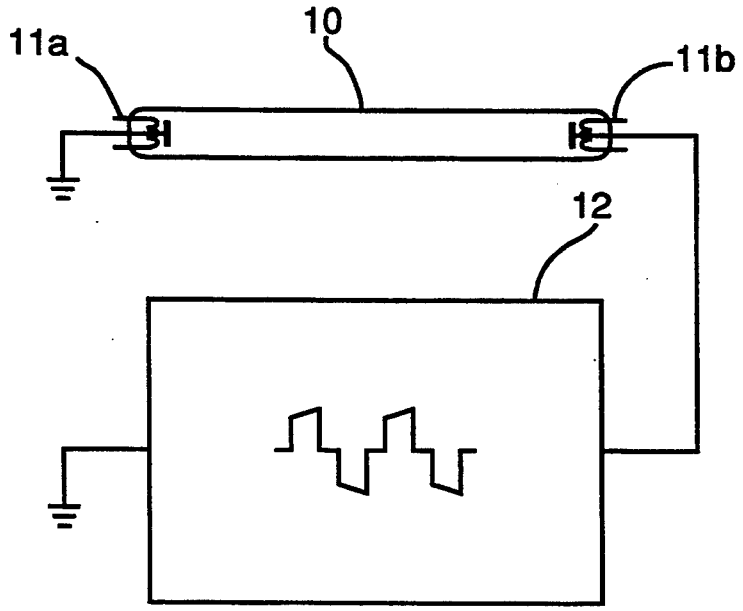
FIG. 1 is a simplified diagram of a fluorescent lamp and its driving circuitry, constructed according to the present invention.
Figure 2:
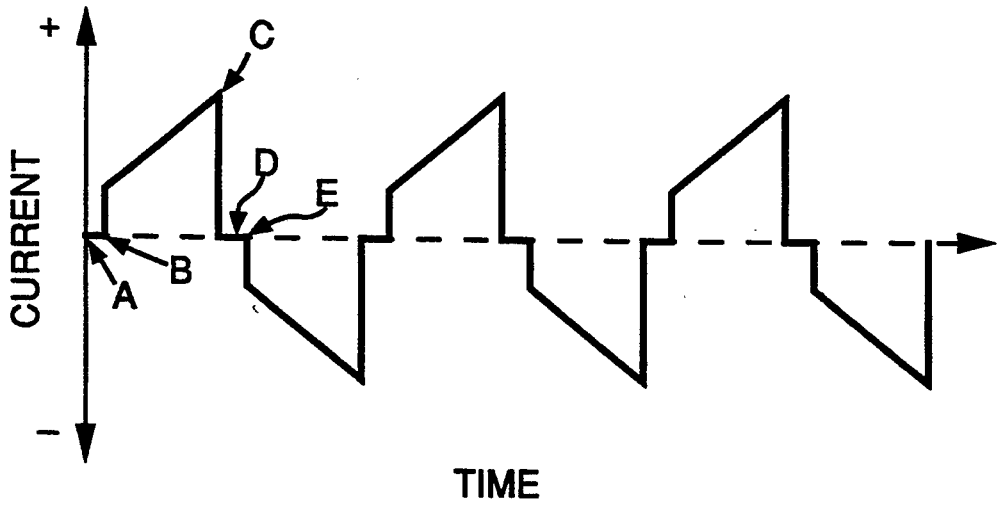
FIG. 2 is a plot of current as a function of time, illustrating a typical shape for the increasing current pulses used to drive a fluorescent lamp in the present invention.

This invention increases the efficiency of a fluorescent lamp by driving the lamp with a source of alternating electrical current, consisting of a series of alternately positive and negative current pulses, and shaping the current pulses such that the absolute value of the current increases as a function of time within each pulse. A simplified diagram of a fluorescent lamp and its driving circuitry, constructed according to the present invention, is illustrated schematically in FIG. 1, where the fluorescent lamp 10, with conventional filament heaters 11*a* and 11*b*, is powered by the drive circuit 12. FIG. 2 is a plot of current as a function of time, illustrating a typical shape for the increasing current pulses used to drive a fluorescent lamp in the present invention.

Figure 3:
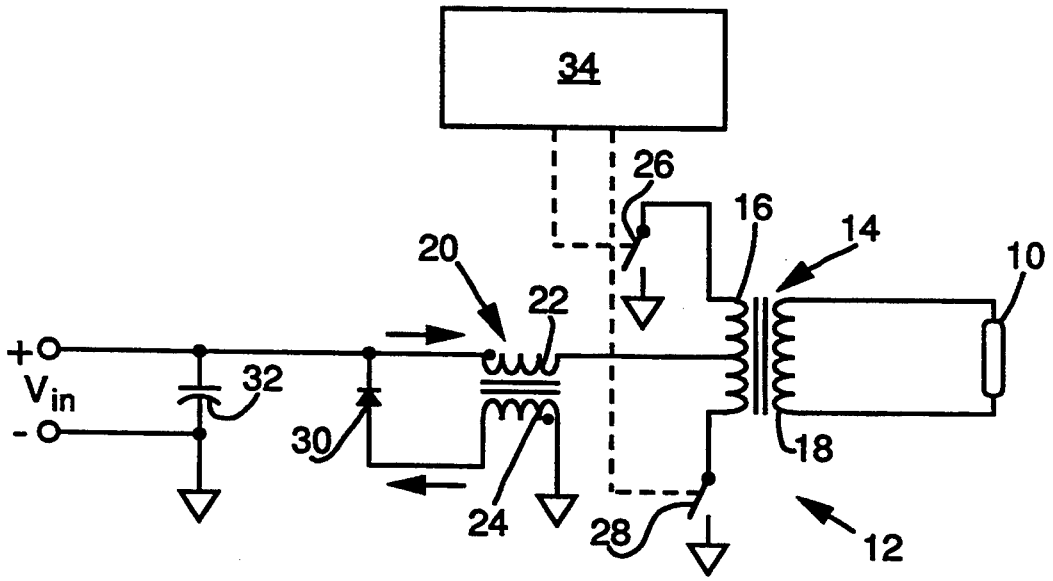
FIG. 3 is a schematic diagram illustrating drive circuitry which can be used to implement the technique of this invention.

FIG. 3 is a schematic diagram illustrating drive circuitry which can be used to implement the technique of this invention. The switched mode drive circuit 12 includes a power transformer 14 having a primary winding 16 and a secondary winding 18, with the secondary winding 18 being connected to the filaments of the fluorescent lamp 10. A flyback transformer 20 includes a primary winding 22 and a secondary winding 24. A fast terminal of the flyback transformer primary winding is connected to the center of the power transformer primary winding 16, while a second terminal of the flyback transformer primary winding is connected to the positive terminal of a source Vin of direct current electrical power.

A first switch 26 is connected between the power transformer primary winding and the negative terminal of the power source, while a second switch 28 is connected between the opposite side of the power transformer primary winding and the negative terminal of the power source. A diode 30 connected between the flyback transformer secondary winding and the flyback transformer primary winding limits current to flowing in the direction from the secondary winding to the primary winding of the flyback transformer. A capacitor 32 is connected between the first and second terminals of the power source. Digital control system 34 is connected to switches 26 and 28 to open and close those switches in a predetermined timing pattern.

Now referring to both FIG. 2 and FIG. 3, in operation the driver circuit of FIG. 3 begins at time A in the waveform of FIG. 2 with both switches 26 and 28 in the closed position. With both switches closed, no current can be passed to the lamp 10 by the secondary winding 18 of the transformer 14, because an equal amount of current is flowing in opposite directions to switches 26 and 28 in the primary winding 16. The flyback transformer 20 acts simply as an inductor when both switches are closed because the diode 30 prevents current flow through the secondary winding 24.

At time B, the switch 26 is opened. This results immediately in current being supplied to the lamp 10 by means of the current flowing through the primary winding 16 and the switch 28. In addition, the inductance of the primary winding 22 of the flyback transformer 20 allows the amount of current to increase in the lamp.

At time C, both switches 26 and 28 are opened. This immediately drops the current supplied to the lamp to zero. In addition, as soon as the switches are opened, the current induced in the secondary winding 24 of the flyback transformer 20 flows through the diode 30 and charges the capacitor. In this manner, the efficiency of the circuit is considerably enhanced because this energy is stored in the capacitor and can be used in a subsequent portion of the power supply cycle rather than being depleted as wasted energy.

At time D, both switches are closed. Then, at time E, the switch 28 is opened. Thereafter, current is supplied to the lamp similar to the operation of the circuit between points B and C, except that current is now flowing in the opposite direction through the primary winding 16 of the power transformer 14 and through the switch 26. Furthermore, the capacitor 32 discharges and supplies its stored energy to the lamp. This cycling of the switches 26 and 28 is repeated by the digital control circuitry 34 to produce a continuing waveform as depicted in FIG. 2. The ratio of the amount of time between points C and D to the amount of time between points D and E determines the amount of current which is applied to the lamp at the beginning of each pulse, i.e., at times B and E.

In a fluorescent lamp, ions are generated by the passage of arc current through the lamp and diffuse to the wall of the lamp, where they recombine. The overall rate of recombination is limited by the relatively slow diffusion process and is therefore fixed. In the steady state condition, the rate of ionization must equal the rate of recombination. Since the rate of ionization responds to the electron temperature, the electron temperature in turn is limited as well. The electron temperature also controls the rate of excitation of the mercury (Hg) atoms, which generate light, and the rate of excitation of the argon (At) atoms, which produce heat. As the electron temperature increases, the cross sections for excitation of Hg increase much more rapidly than those for Ar, so the excitation of the gas by the discharge becomes more efficient. This phenomenon occurs because the elastic scattering due to Ar atoms transfers only thermal energy and hence scales as a low power of the electron temperature. The electronic excitation of Hg, however, involves a threshold that is typically larger than the mean electron energy, hence, only the high energy tail of the Maxwell-Boltzmann distribution is involved. Consequently, the excitation of the Hg atoms is a rapidly increasing (exponential) function of the electron temperature. When the change in current with respect to time (di/dt) in the circuit driving the lamp is not equal to zero, the discharge deviates from the steady state and the rates of ionization and recombination are not equal. When (1/i) (di/dt) is negative, for example, which is typical of fluorescent lamp control systems based on switch mode power supplies, the rate of ionization is reduced (relative to the steady state) as are electron temperature and lamp efficiency. When the change is current is positive, however, the rate of ionization increases along with electron temperature and lamp efficiency. While the increased ionization represents a new loss, it is quite small in comparison to the gain in energy which occurs due to improved competition between the Hg and Ar atoms for excitation by the discharge.

The current density is related to the supply current by the cross sectional area of the lamp and is the product of charge density and drift velocity, the latter factor being a product of mobility and electric field (which is the voltage across the discharge per unit length). When the magnitude of the current is increasing with time, the electric field and lamp voltage must both increase to raise drift velocity because the charge density cannot increase instantaneously. This condition, however, is only transient since electron temperature, which is approximately the product of electric field and mean free path, will also increase and will thereby raise the rate of ionization and eventually increase charge density. At the frequency of the pulses used in typical switch mode fluorescent lamp systems, however, there is insufficient time for charge density to change significantly. The resultant increase in voltage goes almost 100% into the positive column since the nonproductive anode and cathode drops are essentially independent of current. Therefor the distribution of applied power is improved by increasing the fraction of the total that goes into the positive column portion of the discharge where light is generated.

These changes in the current waveform which are utilized in this invention have a pronounced effect on the lamp voltage. A set of "baseline" conditions, typical of a prior an fluorescent lamp control circuit, were defined for the purpose of comparison to a circuit constructed according to the present invention. In the baseline case, the alternating current driving the lamp exhibited a voltage at the leading and trailing edges of each pulse of approximately 30 volts, and the maximum voltage of 60 volts was reached at the center of each pulse, where the light output was also near its maximum value. Hence, the voltage pulses had a "roundtop" appearance. When the modified current waveform of the present invention was applied to the same fluorescent lamp, the potential drop across the lamp at the leading edge was also 30 volts, but this value increased linearly with time to 70 volts at the trailing edge. The corresponding light output was maximized at the trailing edge of each pulse and significant amounts of light emission occurred between adjacent pulses (of opposite sign) while no electrical input was provided to the lamp. This result is not unusual since a few microseconds are required for the electron temperature to decline in the absence of an applied field. As a result of changing the shape of the drive pulse currents to exhibit positive slope, the efficiency of the lamp was found to increase significantly. Moreover, the lifetimes of the filaments in the lamp, which fail due to depletion of barium, were found to increase, as measured by the Ba atom concentration above the filaments, when positive slope waveforms were used. Furthermore, this invention allows a greater amount of power to be supplied to the lamp, as well as improving the ratio of the duty cycle to the crest factor (the ratio of peak to average current).

The sensitivity of the voltage waveform to changes in current may also be attributable to other factors. As the voltage across the lamp increases in order to carry the externally imposed current (by increasing drift velocity), the electric field and electron temperature also rise. The increased electron temperatures cause the atomic cross sections for excitation to increase, which in turn reduces mobility, since this factor scales inversely with the mean (effective) cross section. Therefor the drift velocity does not increase as rapidly as the electric field, and consequently still higher electric fields are required to carry the growing current. Also there are effects from the preceding pulse which influence the initial charge density at the leading edge of subsequent pulses. The recombination or deionization that occurs between pulses is sensitive to duty cycle.

The preferred embodiments of this invention have been illustrated and described above. Modifications and additional embodiments, however, will undoubtedly be apparent to those skilled in the art. As those skilled in the art will appreciate, complete optimization will require variation of the temperature and pressure of the lamp as well as its geometry since these factors are strongly coupled to the phenomena described above. Furthermore, equivalent elements may be substituted for those illustrated and described herein, parts or connections might be reversed or otherwise interchanged, and certain features of the invention may be utilized independently of other features. Consequently, the exemplary embodiments should be considered illustrative, rather than inclusive, while the appended claims are more indicative of the full scope of the invention.

We claim:

1. A method of providing power to a fluorescent lamp, comprising the steps of:

connecting a source of alternating electrical current, consisting of a series of alternately positive and negative current pulses, to the lamp; and shaping the current pulses such that the absolute value of the current continuously increases as a function of time within each pulse.

2. A fluorescent lighting system, comprising:

a fluorescent lamp; and a source of alternating electrical current for providing power to the lamp, the alternating current consisting of a series of alternately positive and negative current pulses, the current pulses being shaped such that the absolute value of the current continuously increases as a function of time within each pulse.

3. The fluorescent lighting system of claim 2, wherein the source of alternating electrical current further comprises a switched mode drive circuit, including:

a power transformer having a primary winding and a secondary winding, the power transformer secondary winding being connected to the lamp;

a flyback transformer having a primary winding and a secondary winding, a first terminal of the flyback transformer primary winding being connected to the center of the power transformer primary winding and a second terminal of the flyback transformer primary winding being connected to a positive terminal of a source of direct current electrical power;

a first switch connected between a first terminal of the power transformer primary winding and a negative terminal of the power source;

a second switch connected between a second terminal of the power transformer primary winding and the negative terminal of the power source;

a diode connected between a first terminal of the flyback transformer secondary winding and the second terminal of the flyback transformer primary winding, such that current is limited to flowing from the secondary winding to the primary winding of the flyback transformer; and a capacitor connected between the first and second terminals of the power source.

4. The fluorescent lighting system of claim 3, further comprising a digital control circuit coupled to the first and second switches to open and close the switches in a time sequenced pattern, thereby causing the current pulses to be shaped such that the absolute value of the current increases as a function of time within each pulse.

5. A fluorescent lighting system, comprising:

a fluorescent lamp;

a switched mode drive circuit, including:

a power transformer having a primary winding and a secondary winding, the power transformer secondary winding being connected to the lamp;

a flyback transformer having a primary winding and a secondary winding, a first terminal of the flyback transformer primary winding being connected to the center of the power transformer primary winding and a second terminal of the flyback transformer primary winding being connected to a positive terminal of a source of direct current electrical power;

a first switch connected between a first terminal of the power transformer primary winding and a negative terminal of the power source;

a second switch connected between a second terminal of the power transformer primary winding and the negative terminal of the power source;

a diode connected between a first terminal of the flyback transformer secondary winding and the second terminal of the flyback transformer primary winding, such that current is limited to flowing from the secondary winding to the primary winding of the flyback transformer; and a capacitor connected between the first and second terminals of the power source;

a source of alternating electrical current for providing power to the lamp, the alternating current consisting of a series of alternately positive and negative current pulses, the current pulses being shaped such that the absolute value of the current increases as a function of time within each pulse; and a digital control circuit coupled to the first and second switches to open and close the switches in a time sequenced pattern, thereby causing the current pulses to be shaped such that the absolute value of the current increases as a function of time within each pulse.

* * * * *